US005924853A

United States Patent [19]

Pacht

[11] Patent Number: 5,924,853

[45] Date of Patent: Jul. 20, 1999

[54] HIGH PRESSURE PUMP

[75] Inventor: Amos Pacht, Houston, Tex.

[73] Assignee: Butterworth Jetting Systems, Inc., Houston, Tex.

[21] Appl. No.: 08/833,966

[22] Filed: Apr. 11, 1997

[51] Int. Cl.[6] ..... F04B 39/10

[52] U.S. Cl. ..... 417/567; 92/171.1

[58] Field of Search ..... 417/567, 569; 92/171.1, 168; 277/531, 511, 520, 525, 510

[56] References Cited

U.S. PATENT DOCUMENTS

| | | | |
|---|---|---|---|
| 3,019,739 | 2/1962 | Prosser | 92/168 |
| 3,049,082 | 8/1962 | Barry | 92/171.1 |
| 4,551,077 | 11/1985 | Pacht | 92/171.1 |
| 4,878,815 | 11/1989 | Stachowiak | 92/171.1 |
| 5,253,987 | 10/1993 | Harrison | 417/567 |
| 5,302,087 | 4/1994 | Pacht . | |
| 5,605,449 | 2/1997 | Reed | 417/567 |

*Primary Examiner*—Charles G. Freay
*Attorney, Agent, or Firm*—Browning Bushman

[57] ABSTRACT

A high pressure fluid pump 10 supplies fluids to a water blasting or cutting gun 14. The pump 10 is preferably of the in-line type, wherein both an inlet check valve 60 and a discharge check valve 62 move linearly along the axis 40 of the plunger 30 during a complete pumping cycle. A plurality of compression rods 42 are spaced circumferentially about a plunger housing 24, and press the plunger housing into sealing engagement with a suction valve seat 56, press the suction valve seat into sealing engagement with a pump discharge housing 36, press the pump discharge housing into sealing engagement with a discharge end plate 38. Seal ring 66 is provided for sealing between a front planar face 114 of the suction valve seat and a rear planar face 112 of the plunger housing. A weep path 116 extends radially outward from the seal ring 66 to release fluids which pass by the compressible seal ring. Plunger housing 24 is provided with a uniform diameter bore 106 extending axially between the plunger seal 54 and the rear planar face 112. A selected bearing material bushing 82 is provided within the plunger housing 24, and a high temperature seal ring 80 is spaced radially outward from a front portion of the bushing to prevent the bushing from becoming seized to the plunger housing. One or more rod front ends 140 may be interconnected with a corresponding compression rod 42 for attaching a support rod 46 thereto during a pump service operation. An alignment connector 28 structurally interconnects a pump rod 26 and a plunger 30, and further reduces the time and expense of pump maintenance.

31 Claims, 3 Drawing Sheets

HIGH PRESSURE PUMP

FIELD OF THE INVENTION

The present invention relates to high pressure pumps and, more particularly, relates to an improved high pressure pump of the type commonly used for supplying pressurized fluid to a blasting gun for cleaning or cutting operations.

BACKGROUND OF THE INVENTION

Those familiar with high pressure blasting equipment commonly used in the surface cleaning and material cutting businesses have long desired a cost effective high pressure pump for providing higher pressure to the blasting gun. In most high pressure blasting applications, the fluid pump must be portable since the surfaces to be cleaned or the material to be cut cannot practically be transported to a stationary pump site. In the cleaning industry, blasting gun operators have long recognized the enhanced effectiveness of water blasting at a fluid pressure of 15,000 PSI compared to water blasting at 10,000 PSI. These individuals have also recognized that a system capable of reliably delivering fluid pressures in excess of 30,000 PSI would be markedly more effective for cleaning purposes, and in many instances would replace sand blasting operations. Those involved in using high fluid pressure for cutting operations similarly recognize that high pressure equipment for cutting, for example, reinforced concrete, would be much more efficient if the fluid system which delivered water to the cutting gun could reliably operate at 35,000 PSI compared to 15,000 PSI.

High pressure pumps employing a plurality of plungers and an in-line valve design as disclosed in U.S. Pat. No. 4,551,077 has been successfully used for generating pressures in excess of 15,000 PSI. U.S. Pat. No. 5,302,087 discloses a technique for loading the pump compression rods which reliably seal the suction manifold with both the upstream plunger housing and the downstream discharge housing, thereby reducing leakage and facilitating pump maintenance and repair.

Those skilled in the design and engineering of high pressure pumps have long recognized that significant problems must be overcome to provide a cost effective high pressure pump capable of outputting 30,000 PSI or more. Numerous problems which are either absent or have little effect in the design, manufacture, and operation of a 15,000 PSI pump become critical to the successful operation of a pump capable of delivering 30,000 PSI or more. At these high pressures, the compressibility of water and its effect on pump efficiency must be considered, and accordingly the size of the fluid chamber containing compressed fluid between the plunger at the end of its pumping stroke and the discharge check valve must be limited. Efforts are accordingly undertaken to reducing this "dead zone" chamber, but in many cases such techniques are contrary to the life of the pump and require increased pump maintenance.

As the pressure output for the fluid pump increases, pump parts become more susceptible to galling and to reduced life due to elevated fluid temperatures. The temperature of compressed water increases approximately 3° F. per thousand PSI, and accordingly water supplied to the inlet of the pump at 80° F. reaches a temperature in excess of 180° F. while within the pump, thereby adversely effecting the life of seals and contributing to galling of metal pump components.

Although numerous obstacles are encountered developing a reliable high pressure pump capable of delivery pressures of approximately 35,000 PSI to blasting equipment, businesses using such pumps for cleaning or cutting operations have long desired such a pump. The improved high pressure pump as hereafter disclosed will have significant benefits for those involved in the blasting operations. The portable high pressure pump of the present invention is highly reliable, and is able to deliver fluid pressure in excess of 35,000 PSI to the blasting or cutting gun.

SUMMARY OF THE INVENTION

In a preferred embodiment, the high pressure pump utilizes an in-line pump design, wherein the suction valve seat houses at least a portion of both the inlet check valve and the discharge check valve. The suction valve seat is pressed into sealing engagement with the plunger having by a plurality of compression rods spaced circumferentially about the plunger housing. Both the inlet check valve that passes fluid to the pump chamber and the discharge check valve that prevents high pressure downstream fluid from returning to the pump chamber are movable along an axis substantially coincident with the central axis of the corresponding pump plunger.

In order to minimize the forces acting on the pump compression rods, the diameter of the seal between the suction valve seat and the plunger housing is reduced and, most importantly, a weep groove is provided between the suction valve seat and the plunger housing so that any fluid which bypasses this seal does not contribute to the build up of forces which must be countered by the compression rods. Any fluid passing by this seal instead escapes to the exterior of the plunger housing, where it serves as a visual indication to the pump operator that service of the pump is required. The annular fluid receiving chamber in the suction valve seat is configured to facilitate pre-stressing of the suction valve seat, and to minimize the diameter of the suction valve seat while transmitting forces between the plunger housing and the discharge housing without deforming the suction valve seat. A seal ring is provided on each side of the annular fluid receiving chamber in the suction valve seat to seal between the suction manifold and the suction valve seat, while no seal is provided between the suction manifold and the plunger housing.

In order to minimize stress concentration locations on the plunger housing, this housing is provided with a uniform diameter bore extending axially from the packing for sealed engagement with the plunger to the suction valve seat. A stop sleeve positioned in this bore engages the suction valve seat, and a spring acting between the stop sleeve and a packing ring compresses the packing to reliably seal with the reciprocating plunger. The packing ring is configured to minimize the volume of the pump chamber when the plunger is at the end of its compression stroke, thereby minimizing dead zones within the pump and enhancing pump efficiency.

A gland nut is connected to the end of the plunger housing axially opposite the suction valve seat, and presses against a bronze bushing which in turn presses against the packing. The bronze bushing has an internal bore finish for acting as a bearing for the reciprocating plunger. To reduce maintenance problems associated with the high temperatures produced by the pump, a tungsten carbide sleeve ring is provided between a portion of the bronze bushing and the stainless steel plunger housing, thereby reducing the likelihood of the bronze bushing becoming seized or welded to the plunger housing. To achieve a relatively compact pump design and cool the pump plunger, a cooling fluid port is provided in both the plunger housing and the bushing at a position spaced axially toward the power end of the pump relative to the bronze bushing. Accordingly, the plunger is cooled by fluid engaging the plunger upstream from the bronze bushing, with the cooling fluid being discharged through one or more cooling fluid discharge ports in the gland nut.

At least some of the compression rods are provided with extension studs which are welded to the ends of the compression rods. During repair of the pump, extension rods may be threaded to the extension studs to serve as supports for the torque plate, the discharge housing, and the suction manifold. A check valve housing and a gauge adapting plate may each be mounted on opposing sides of the discharge housing to reduce external plumbing connections. After repair of the pump, the extension rods may be easily removed from the extension studs so that the pump size is only slightly increased.

The pump also includes an alignment connector between the plunger and the pump rod which is connected to the power end of the pump. The alignment connector includes a uniform collet nut and a plunger bushing sized for a particular diameter plunger. A plunger adapter cap is threaded to a short connector rod, and engages an adapter ring interconnected with the pump rod. Accordingly, misalignment between the adapter ring and the plunger adapter cap is possible. The alignment connector also facilitates disconnection of the plunger and the pump rod during service of the pump, thereby facilitating removal of the gland nut from the plunger housing.

It is an object of the present invention to provide an improved high pressure pump for reliably supplying pressurized fluid to a blasting or cutting gun. The pump of the present invention is able to generate fluid pressures in excess of 30,000 PSI, and more particularly in excess of 35,000 PSI, thereby significantly increasing the efficiency of the blasting or cutting operation.

It is a feature of the present invention that the pump is designed and constructed to have a relatively long life between maintenance operations, and that the time and expertise required for pump maintenance operations is significantly reduced.

Yet another feature of the invention is that the alignment connection allows for some misalignment between the pump rod and the plunger, and also facilitates repair of the pump.

It is a significant advantage of the present invention that the dead zone in the pump is minimized, while a number and complexity of the pump components is reduced to facilitate long-term and reliable operation.

These and further objects, features, advantages of the present invention will become apparent from the following detailed description, wherein reference is made to the figures in the accompanying drawings.

DETAILED DESCRIPTION OF PREFERRED EMBODIMENTS

Figure 1:
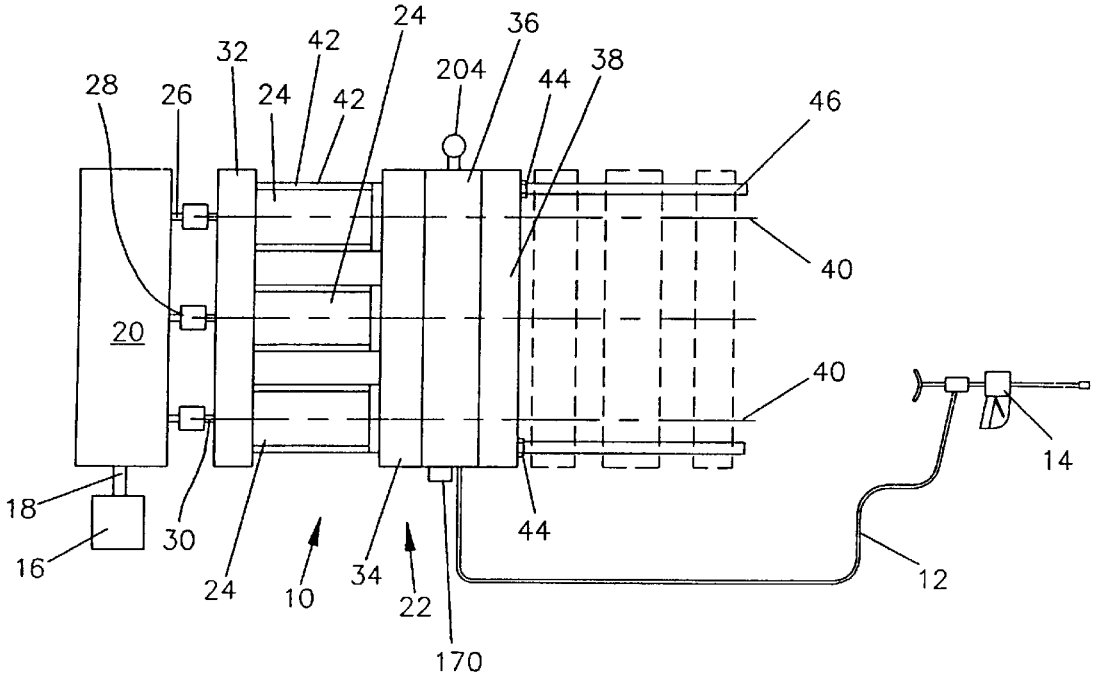
FIG. 1 is a simplified pictorial view of the high pressure pump according to the present invention for use in a blasting operation. Rod extensions are shown connected to the fluid end of the pump, and the repair position for the end plate, the discharge housing, and the suction manifold are illustrated in dashed lines.

FIG. 1 generally depicts a high pressure pump 10 according to the present invention. Pump 10 is preferably portable so that it can be easily transported to the site of a surface cleaning or blasting operation, or to the site of a cutting operation. The pump 10 discharges high pressure fluid through flexible hose 12 to a blasting or cutting gun 14. An operator (not shown) may thus manipulate the gun 14 for blasting the surface to be cleaned with high pressure water. Because of the high pressure output by the pump 10, the blasting operation may be accomplished more efficiently than prior art surface cleaning operations, including conventional sandblasting operations which impinge the surface to be cleaned with metal shot, which then must be recovered. The pump 10 may also be used for supplying high pressure water to a cutting gun 14, which may be used for cutting various types of materials, including steel and concrete.

The pump 10 is powered by suitable motor or engine 16 which transmits torque through the drive shaft 18 to the power end 20 of the pump. The pump 10 may either have a single or a plurality of plungers which are each reciprocated within a suitable plunger housing 24. The fluid end 22 of the pump as shown in FIG. 1 contains three such housings 24. Accordingly, the power end or pump driver 20 is provided with three reciprocating pump rods 26 which are each connected by an alignment connector 28 to a corresponding plunger 30 which moves linearly within a respective plunger housing 24. Alignment connector 28 is shown in detail in FIG. 6 and is discussed subsequently.

The fluid end 22 of the pump 10 includes an upstream packing end housing 32, an inlet or suction manifold 34, a discharge manifold 36 and a discharge end plate or torque plate 38. Each of the components 32, 34, 36 and 38 may be provided as a unitary component for cooperating with the three individual plunger housings 24, although alternatively separate components may be provided each associated with a respective one of the plunger housings 24. Each of the pump rods 26 is thus reciprocated along a respective one of the three parallel axes 40, thereby linearly moving a respective plunger 30 within a respective plunger housing 24 to generate the desired high pressure. A plurality of compression rods 42 are spaced circumferentially about each of the plunger housings 24. A nut 44 is provided on the end of each compression rod 42, and tightening of the nut 44 thus compresses the packing end housing 32 into sealed engagement with each plunger housing 24, compresses each plunger housing 24 into sealed engagement with the inlet or suction manifold 34 (or into sealed engagement with a respective suction valve seat within the inlet manifold, as discussed subsequently), presses the inlet manifold 34 (or the respective suction valve seats) into sealed engagement with the discharge manifold 36, and presses the discharge manifold 36 in engagement with the discharge end plate 38.

One of the features of the present invention relates to repair of the fluid end 22 of the pump 10. For the present, it should be understood that an extension rod 46 may be removably interconnected with an end of each of the compression rods 42 as shown in FIG. 1. During pump service, the corresponding nuts 44 may be unthreaded from the compression rods 42. Two or more of the extension rods 46 may thus provide structural support for pump components to facilitate repair and service of the pump. Those skilled in the art will appreciate that, during a pump service operation, the discharge end plate 38, the discharge housing 36, and the inlet manifold 34 may thus be positioned along and supported by the extension rods 46 as shown in dashed lines in FIG. 1. After service, these components are returned to the position as shown in solid lines in FIG. 1, and the extension rods 46 may then be removed so that the size of the pump 10 when in use is minimized. The pump extension rods as shown in FIG. 2 are farther discussed subsequently.

Figure 2:
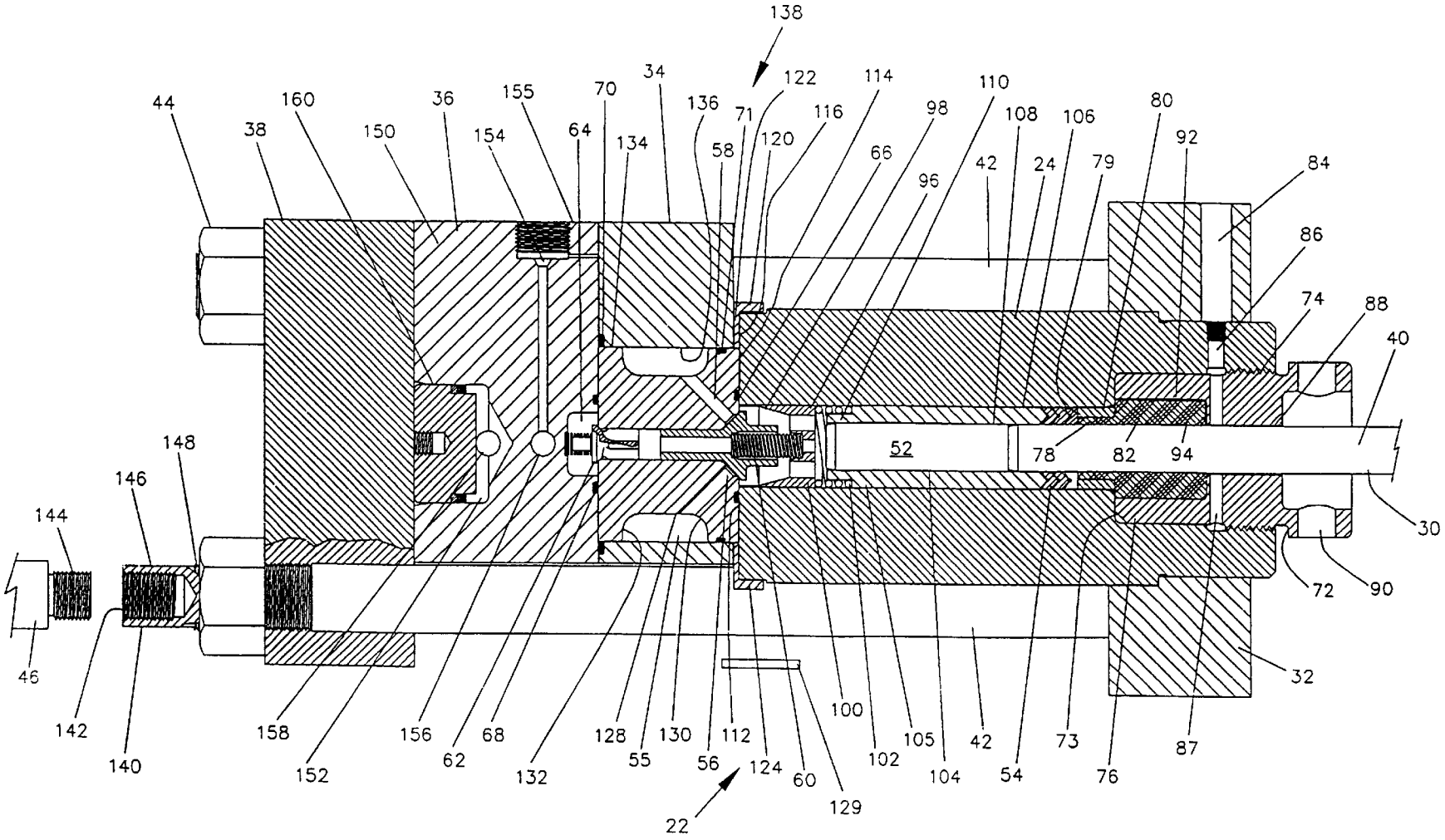
FIG. 2 is a cross-sectional view of the fluid end of the pump shown in FIG. 1.

FIG. 2 depicts in greater detail the fluid end 22 of a suitable high pressure pump 10 according to the present invention, and more specifically illustrates the components associated with only one of the plungers 30 generally shown in FIG. 1. As shown in FIG. 2, the upstream packing end housing 32, the suction manifold 34, the discharge housing 36, and the downstream end plate or torque plate 50 are illustrated as separate components. As previously noted, one or more of the components may be a unitary component for cooperation with each of the three plungers and plunger housings, or structurally separate components may be associated with each of the three plungers, as shown in FIG. 1. Since the construction of these components associated with the plungers is preferably identical, however, the illustration in FIG. 2 should be understood to apply for the similar components associated with each of the three plungers 30 as shown in FIG. 1.

The plunger housing 24 provides a cylindrical plunger chamber 52 therein. The plunger 30 as shown in solid lines in FIG. 2 is at the end of its compression stroke, while the end of the plunger 30 at the end of its suction stroke is shown in dashed lines in FIG. 2. The plunger 30 is thus linearly moveable within the pump chamber 52 along the central pump axis 40 during a stroking of the pump. Packing 54 maintains a fluid-tight seal between the plunger 30 and the plunger housing 24 during this reciprocal movement.

A fluid inlet line (not shown in FIG. 2) interconnects a liquid supply to an annular fluid inlet 55 in a suction valve seat 56. Seat 56 in turn is positioned within the inlet manifold 34. A plurality of fluid passageways 58 interconnect the annular chamber 55 to the plunger chamber 52 so that fluid flows into the plunger chamber 52 during the suction stroke of the plunger 30. During this suction stroke, the inlet check valve 60 unseats from sealing engagement with an upstream end of the suction valve seat 56, and then closes to seal with the seat 56 during the compression stroke of the pump. During the compression stroke, the discharge check valve 62 unseats from sealing engagement with a downstream end of seat 56 to allow pressurized fluid to pass from the chamber 52 into the chamber 64 in the discharge housing 36. During the pump pressure stroke, high pressure fluid thus passes from the chamber 52 through a center passageway in the inlet check valve 60 and then passes by the discharge check valve 62 to enter the chamber 64. Although not shown in FIG. 2, the chamber 64 is in fluid communication with pump discharge line 154 in the housing 36. Line 154 is thus fluidly connected to flexible hose 12, which transmits high pressure fluid to the gun 14, shown in FIG. 1. During the suction stroke, the discharge check valve 62 thus seats with the seat 56 to prevent high pressure fluid in the chamber 64 from the returning to the plunger chamber 52. Both the inlet check valve 60 and the discharge check valve 62 move linearly along the axis 40 between their respective opened and closed positions, thereby achieving the desired inline design for the pump.

Seal 66 provides a high pressure seal between the plunger housing 24 and the suction valve seat 56. The seal must withstand the high pressures generated within the pump chamber 52 during the compression stroke. Seal 68 between the pump discharge housing 36 and the suction valve seat 56 similarly must withstand high pressure, although the diameter of the seal 68 desirably may be less the diameter of the seal 66. More importantly, the seal 66 is continually subject to repeated high pressure and low pressure during the pumping stroke and is thus more likely to fail than the seal 68, which is continually subject to high pressure during pump operation. Seal 70 provides a low pressure seal between the suction valve seat 56 and the suction manifold 34, and also a backup seal between the suction manifold 34 and the discharge housing 36. The seal 71 similarly provides a low pressure seal between an upstream side of the suction valve seat 56 and the suction manifold 34. The seals 66, 68, 70 and 71 are somewhat enlarged in FIG. 2 for clarity.

The components described are maintained in sealing engagement by a plurality of compression rods 42 which are spaced circumferentially about the plunger housing 40. Each rod 42 thus has a threaded end which may be structurally threaded to the upstream packing end housing 32. One or more of the rods 40 pass through holes provided in the housings 34, 36, and 38, and nuts 44 may be conventionally torqued to provide the desired compressive force to maintain these components in sealed engagement. The suction valve seat 54 is thus sealingly sandwiched between the plunger housing 24 and the pump discharge housing 36 due to the forces transmitted by the compression rods 42.

A particular feature of the present invention relates to the ability of the pump 10 to be able to generate high fluid pressure while minimizing forces on the rods 42. To reliably transmit compressive forces between the plunger housing 24 and the suction valve seat 56 without distorting the suction valve seat, tight planar engagement is desired between the rear planar face 112 of the plunger housing and the front planar face 114 of the seat 56. In spite of efforts taken to ensure the long-term sealing effectiveness of seal 66 between the plunger housing 24 and the suction valve seat 56, some leakage of fluids past the seal 66 will likely occur over time, particularly since the repeated forces due to high pressure and low fluid pressure act on the seal 66 as discussed earlier during each complete pumping stroke, and thus adversely affect seal life. Applicant has discovered that only a small amount of fluid leakage past the seal 66 and trapped between the planar faces 112 and 114 significantly increases the forces which must be resisted by the compression rods 42, and thus contributes to high maintenance for the pump. Accordingly, the pump of the present invention continues to employ tight planar engagement of the rear planar face 112 of the plunger housing 24 with the front planar face 114 of the suction valve seat 56 is provided, but a weep path 116 is also provided extending radially outward from the seal ring 66 to a location exterior of the plunger housing 24 for releasing fluids which pass by the seal 66. Accordingly, the weep path 116 desirably prevents the buildup of pressure between the planar faces 112 and 114, thereby both reducing the size of the rods 42 and minimizing extensive pump repair.

Figure 3:
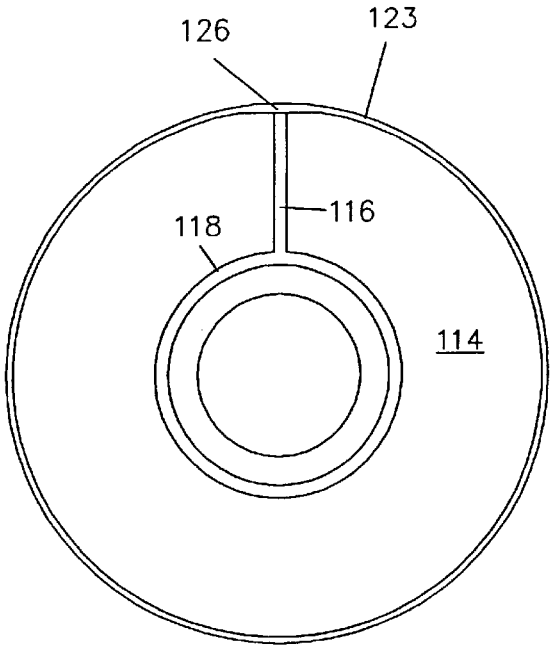
FIG. 3 is an end view of the plunger housing shown in FIG. 2, illustrating the leak path for fluids which pass by the seal.

Referring to FIG. 3, the front planar face 114 of the plunger housing 24 is depicted. The compressible seal ring 66 provided in an appropriate groove in the suction valve seat 56 thus seals with the planar face 114 of the plunger housing 24. A relatively short radial gap (not shown in FIG.

3 since the seal 66 is on the seat 56) is provided between the exterior of the seal 66 and the commencement of the weep groove 116. This slight gap or spacing between the seal ring 66 and the weep groove thus effectively minimizing the likelihood of the seal ring extruding into the weep groove under high pressure. Fluid which bypasses the seal 66 may flow into the weep groove 116 and radially outward of the plunger housing in order to desirably release these fluids. Since a small amount of fluid may bypass the seal 66 at any location along the circumference of the seal 66, it is a further feature that an annular groove 118 as shown in FIG. 3 be provided in the front planar face 114 of the plunger housing 24. The annular groove 118 is also spaced radially outward from an outer edge of the seal ring 66 to prevent seal extrusion. Groove 118 thus provides fluid communication between any area slightly radially outward from the seal ring 66 and the weep groove 116. Accordingly, any small amount of fluid which leaks past the seal ring 66 promptly enters the annular groove 118, which is at atmospheric pressure with the exterior of the plunger housing due to the weep path 116. Accordingly, fluid leakage past seal ring 66 cannot significantly increase forces in the rods 42. While the weep groove 116 and the annular groove 118 may be formed in either the front planar face of the suction valve seat or the rear planar face of the plunger housing, these grooves are preferably cut in the plunger housing 24, as shown in FIG. 3.

Referring again to FIG. 2, it may be seen that the seal ring 66 has a diameter only slightly greater than the diameter of the cylindrical bore 106 in the plunger housing 24. The diameter of the seal ring is minimized in order to reduce the forces on the rods 42. Preferably the seal ring 66 has a nominal seal diameter which is less than 125% of the diameter of the cylindrical bore 106 in the plunger, and preferably the seal ring 66 has a diameter less than 120% of the diameter of the bore 106.

Still referring to FIG. 2, a locating ring 120 is provided for radial alignment of the suction valve seat 56 with the plunger housing 24. The locating ring 120 thus has a plate portion 122 which is parallel to the planar faces 112 and 114, and a circular flange portion 124 which is perpendicular thereto and performs the alignment function. The locating ring 120 is thus spaced radially outward from the suction valve seat 56 and is in engagement with both a radially outer surface of the suction valve seat 56 and a radially outer alignment 123 surface (see FIG. 3) of the plunger housing 24 for alignment of these components during assembly of the pump. To allow for the escape of fluids which pass by the seal 66 as described above, a flat 126 is provided on the exterior surface of the plunger housing 24 as a break in the otherwise circular alignment surface 123, so that any fluids in the groove 116 can escape to the exterior environment between the flange 124 of the locating ring 120 and the flat 126. As shown in FIG. 2, a plate 129 may be positioned for collecting fluids from the weep groove on a collection surface, such that a pump operator may visually detect leakage of fluids which pass by the seal 66 and accumulate on the plate 129. The weep groove 114 may extend radially outward in any direction from the centerline 40, and accordingly the plate 129 may be positioned at any appropriate location for receiving the small amount of escaping fluids which accumulate on a plate. If the weep groove is positioned so that the escaping fluids pass upward through a weep groove, the top surface of the plunger housing 24 adjacent the flat 126 may thus serve as the fluid collection surface. Those skilled in the art will appreciate that a relatively small amount of fluids will pass by this seal 66, but that these collected fluids may reliably serve as an indication when pump repair, and specifically replacement of the seal 66, is required.

Since a weep path 126 desirably is provided in a locating ring 120, a low pressure seal between the upstream side of the suction manifold 34 and the plunger housing 24 is not provided. Instead, a low pressure seal is provided between the suction manifold 34 and the upstream side of the suction valve seat 56, with this seal being effected by the seal ring 71.

Yet another feature of the invention relates to the configuration of the annular inlet chamber 55 in the suction valve seat 56. According to the present invention, the annular inlet chamber 55 is configured to facilitate prestressing of the suction valve seat 56, and is also configured to allow for the reliable transmission of compressive forces between the plunger housing 24 and the discharge housing 36 without bending or distorting the suction valve seat 56, while also minimizing the overall size of the suction valve seat 56. More specifically, the annular inlet chamber 55 is spaced radially a uniform distance from the central axis 40 and, as previously noted, one or more fluid passageways 58 interconnect the annular chamber 55 with the plunger chamber 52. The annular inlet chamber 55 has a substantially cylindrical radially inward surface 128 spaced substantially a uniform radial spacing from the central axis 40, and has both an upstream curved side surface 130 and a downstream curved side surface 132 which interconnect the radially inward surface 128 with a radially outward cylindrical surface 134 of the suction valve seat 56. The upstream and downstream sides of the surfaces 130 and 132 thus intersect the outer cylindrical surface 134 of the suction valve seat in substantially a perpendicular manner, as shown in FIG. 2. In turn, the upstream and downstream outer cylindrical surfaces 134 of the suction valve seat are in mating engagement with the corresponding cylindrical interior surface 136 of the suction manifold 34, as shown in FIG. 2.

Rather than providing an annular chamber 55 in the suction valve seat 56 which in cross-section has a generally semi-circular configuration commonly used in prior art suction valve seats, suction valve seat 56 as discussed above has in cross-section a much more rectangular configuration. The radially inward surface 128 and the curved side surfaces 130 and 132 which each preferably intersect the end surface 134 of the suction valve seat in a substantially perpendicular manner thus form the desired generally rectangular cross-section of the chamber 55. This design of the suction valve seat 56 reduces the overall diameter of the suction valve seat compared to prior art designs, but the volume of the chamber 55 is not reduced. Also, the radially inward surface 128 durably has a diameter larger than the diameter cylindrical bore 106 in the plunger housing 24, so that high forces may be transmitted from the housing 24 to the discharge housing 36 without bending the suction valve seat 56. Each curved side surface 130 and 132 preferably has a uniform radius not less than 10% but more than 25%, and preferably not less than 15% but not more than 22%, of the radius of the outer cylindrical surface 134 of the suction valve seat. This radius is sufficient to avoid undesirable stress concentration points, but is not so large that either the surface of the chamber 55 is sacrificed or the diameter of the surface 128 reduced beyond an acceptable level relative to the diameter of the outer surface 134 of the suction valve seat. Also, the end of these radiused surfaces are smoothly tangent to the inward surface 128 and the perpendicular side surfaces, thereby avoiding any discontinuities which tend to form stress concentration locations. This configuration thus contributes to a desired high volume for the annular inlet chamber 55 and, as previously noted, contributes to both pre-stressing of the suction valve seat 56 and allows reliably forces to be transmitted between the plunger housing 24 and the discharge housing 36 in a manner which is not possible if the cross-sectional configuration of the inlet chamber were generally semi-circular.

The upstream end of the fluid end 22 of the pump includes a gland nut 72 which is threadably connected to the plunger housing 24 by threads 74. A bushing 76 is pressed by the gland nut toward the suction valve seat 56, so that the bushing 76 presses against the packing 54. A front portion 78 of the bushing has a reduced diameter, and a high temperature resistant sleeve 80 is spaced radially between the front portion 78 of the bushing and the plunger housing 24. Since the rear portion 82 of the bushing is prevented from contact with the plunger housing 24 by the gland nut 72, it may be seen that no radially outer surface of the bushing 82 desirably engages the plunger housing.

Upstream packing end housing 32 includes a inlet passage 84 therein, and corresponding passageways 86 in the plunger housing 24 and 87 in the gland nut 72 allow a cooling fluid to engage the plunger 40 at a position spaced upstream from the bushing 82. Cooling fluid thus may flow in the annulus 88 between the plunger and the inner surface of the gland nut 72, then out one or more of the discharge ports 90 in the gland nut. As shown in FIG. 2, a pressure release groove 92 is spaced between the gland nut 72 and the rear portion 94 of the bushing 82. The groove 92 extends axially along the rear portion 94 of the bushing 82 releasing any small amount of fluid to the passageway 87 which passes by the packing 54. The pressure release groove 92 may be provided along either an inner surface of the gland nut 72 or an outer surface of the bushing 82.

A particular feature of the invention is the use of a high temperature resistant sleeve 80 to prevent the outer surface of the front portion 78 of the bushing 82 from engaging the plunger housing 24. The bushing 82 may be formed from any number of suitable bearing materials, such as bronze, while the sleeve 80 is desirably formed from a hard and heat-resistant material, such as tungsten carbide. Due to the high pressures created by the pump, prior art bushings have tended to become seized or welded to the plunger housing. The sleeve 80 of the present invention and the cooling channels as described above significantly reduce or eliminate this likelihood, thereby allowing the gland nut 72 to be unthreaded from the plunger housing 24 and both the bushing 82 and the sleeve 80 easily removed from the interior of the plunger housing in order to replace the packing material 54.

For the embodiment as shown in FIG. 2, a front compression face 79 of the bushing 82 is configured for pressing engagement with the plunger seal 54. Preferably the front portion 78 of the bushing 82 extends into engagement with the plunger seal 54, since the bearing area of the bushing 82 for sliding engagement with the plunger 30 is preferably maximized and since the sleeve 80 preferably does not engage the plunger 40. The sleeve ring 80 extends axially from the plunger seal 54 to adjacent a front end surface 73 of the gland nut 72, so that substantially the entirety of the radial outer surface of the bushing 82 is in engagement with either the sleeve ring 80 or the gland nut 72, and is thus spaced radially from the plunger housing 24. The gland nut 72 thus fixes the radial position of the bushing 82 within the plunger housing 24, and the sleeve ring 80 fills the annular space between the front portion 78 of the bushing and the plunger housing.

A valve stop sleeve 96 is provided within the plunger housing for engagement with the suction valve seat 56. The stop sleeve 96 has a forward end 98 with a very thin radial cross-section to accommodate the inlet check valve 60 and to allow for the flow of fluids from the passageways 58 into the pumping chamber 52. Preferably the forward end 98 of the stop sleeve has a radial thickness less than 30% of a radial thickness of the rearward end 100 of the stop sleeve. A coil spring or other biasing member 102 is positioned within the plunger housing 24, and acts between the stop sleeve 96 and the packing ring 104 to bias the packing ring against the packing 54. The packing ring 104 has a uniform diameter outer surface 105 for engagement within the uniform diameter cylindrical bore 106 within the plunger housing 24, and has a uniform diameter inner surface 108 for sliding engagement with the outer cylindrical surface of the plunger 30. The packing ring 104 is thus configured to minimize dead zones within the pump when the plunger is at the end of the pump compression stroke. The front end 110 of a packing ring 104 also extends axially from a front coil of the spring 102 toward the stop sleeve 96 to further minimize dead zones within the pump.

The plunger housing 24 thus has a uniform diameter bore 106 extending axially from upstream of the plunger seal 54 to the rear planar face 112 of the plunger housing in engagement with the suction valve seat 34. By providing a uniform diameter bore 106 between the seal 54 and the planar face 112 of the plunger housing, stress concentration points in the plunger housing are significantly reduced compared to prior art pumps, wherein the bore in the plunger housing did not have a uniform diameter between these locations. By minimizing the stress points, pre-stressing of the plunger housing 24 is facilitated and, most importantly, high stress concentration points associated with corners adjacent the differing bore diameter intersections are eliminated. A reliable high pressure pump preferably is obtained by providing a plunger housing with a uniform diameter bore extending axially from at least the plunger seal to the rear planar face of the plunger housing, which in turn is in mating engagement with the suction valve seat. Moreover, the valve stop sleeve 96 and the packing ring 104 are configured to minimize dead zones in the pump which detract from pump efficiency. The volume occupied by the biasing member 102 is also minimized to further avoid dead zones in the pump and enhance pump efficiency.

The pump repair feature of the invention relating to the use of support rods 46 may be now understood in conjunction with FIGS. 1 and 2. Two or more of the compression rods 42 are preferably provided with a rod front end, such as front end 140 shown in FIG. 2, which is configured for engagement with a corresponding support rod 46. When the rod front end 140 and the corresponding support rod 46 are structurally connected, the support rod extends outward from the end plate 38 to support one or more of the components 38, 36, and 34 as shown in dashed lines in FIG. 1, thereby facilitating repair of the pump. Each rod front end 140 includes a threaded port 142 therein which is sized for receiving a corresponding threaded end 144 of a support rod 46. The diameter of support rod 46 and the diameter of the rod front end 140 are not greater than the crest diameter of the threads in the nut 44, and accordingly a support rod 46 may be interconnected with the rod front end 140 and the nut 44 unthreaded from the compression rod 42, then the nut slid rearward past the rod front end and along the support rod 46. The front end plate or torque plate 38 may then be slid rearward along the support rod 46 during the pump service operation. The discharge housing 36 and the fluid inlet manifold 34 may similarly be slid rearward along the support rod for the pump service operation. Those skilled in the art will appreciate that the support rods 46 need not be as long as depicted in FIG. 1, and need only be sufficiently long to provide the desired radial spacing between these components to facilitate repair. After the repair operation is complete, the nuts 44 may be slid back in place and again threadably connected to the compression rods 42. Once the pump is fully assembled, the support rods 46 may be removed, so that the size of the pump is not significantly increased during use of the pump.

As shown in FIG. 2, each rod front end may include an extension stud 146 which is fixed to the end of the corresponding compression rod 42. While various means may be used to structurally fix the stud 146 to a corresponding rod 42, structural connection by a weld 148 is preferred. The weld may be provided in an undercut groove between these components, and the outer surface of the weld may be ground to ensure that the nut can pass by the weld. The stud 146 preferably is affixed to the rod 42, of course, prior to any pump assembly operation. In an alternate embodiment, the rod front end 140 is merely a reduced diameter extension of a unitary rod 42, with the diameter of the stud being reduced to allow the nut to pass over the rod front end, as explained above.

The pump of the present invention preferably includes the ability to use high pressure generated by the pump to load the compression rods 42. This feature of the pump is described in U.S. Pat. No. 5,302,087, hereby incorporated by reference. As explained more fully in the referenced patent, the pump discharge housing 36 includes a front pressure housing portion 150 which includes a liquid pressure chamber 152 therein. The liquid pressure chamber 152 is in fluid communication with the pump discharge flow line 154 by a compression line which includes an upstream compression line portion 156 and a downstream compression line portion 158. The chamber 152 may thus be exposed to high pressure output from the pump for exerting a force on a pressure-transmitting piston 160, which is movable within the chamber 152. Piston 160 thus transmits a high force to the end plate or torque plate 38 and then to the compression rods 42 in order to create the desired axial load on the compression rods to maintain sealing engagement between the components discussed above. Prior to energizing the pump, the nuts 44 may thus be snugly tightened, but only at a low torque. The pump may then be activated to generate a preselected high pressure, which preferably will be the maximum pressure at which the pump is intended to operate. While the pump is operating at this desired high pressure, the compression line is opened so that high pressure fluid is allowed to flow into the chamber 152 to create the desired load on the compression rods. The compression line to the chamber 152 may then be closed, thereby maintaining desired high loads on compression rods 42.

Figure 4:
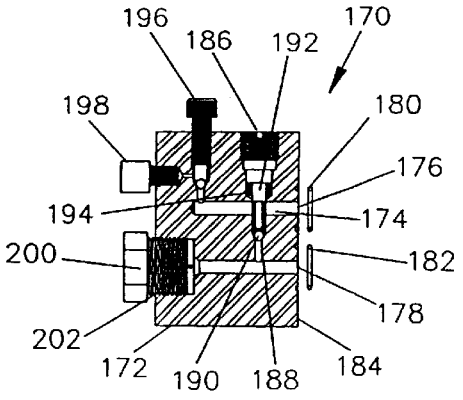
FIG. 4 is a cross-sectional view of a check valve housing for mounting on the side of the discharge manifold.

It is a further feature of the invention to reduce the external lines which interconnect the high pressure discharge line 154 in the discharge housing 36 to the liquid pressure chamber 152, and most importantly to reduce piping or other plumbing external of the discharge housing and thereby minimize leak points. According to the present invention, a control valve housing 170 as generally shown in FIG. 1 and more particularly shown in FIG. 4 is employed to reduce these external connections. The control valve housing 170 includes a generally rectilinear metal block 172 with a U-shaped center compression line portion 174 therein. The inlet port 176 of center compression line portion 174 is thus in fluid communication with the upstream compression line portion 156 in the discharge housing 36, while the discharge port 178 similarly is in fluid communication with the downstream compression line portion 158 which flows to the liquid pressure chamber 152. O-ring seals 180 and 182 provide fluid tight sealing engagement between the planar face 184 of the block 172 and a mating side face on the discharge housing 36. A control valve 186, which preferably is a regulatable check valve, is supported on the block 172 and is spaced along the center compression line portion 174 for controlling the release of high pressure between the lines 156 and 158, thereby controlling the flow of high pressure fluid to the liquid pressure chamber 152. More particularly, the valve end 188 of the check valve 186 is designed for sealing engagement with the conical seat 190 in the block 172 to seal off flow between the ports 176 and 178. The valve stem 192 may be moved upward from the position as shown in FIG. 4, however, to open communication between the ports 176 and 178. Conventional packing seal 194 is provided for preventing the inadvertent release of fluids from the block 172.

Control valve housing 170 further includes a pressure relief valve 196 which is provided for relieving pressure from the chamber 152 prior to a pump repair operation. The pressure relief valve 196 may be of the type which is manually controllable so that the operator may release pressure from chamber 152. Due to the high pressure forces, relieved pressure does not pass through the valve 196, and instead passes into an elbow 198 in fluid communication with a downstream side of the valve 196. Elbow 198 and a relief line (not shown) thus safely release pressure from chamber 152.

A plug 200 may be provided in a threaded port 202 in fluid communication with the central compression line portion 174. If desired, the plug 200 may be removed and a transducer, pressure gauge, or other component threadably connected to the port 202 to monitor the pressure in the chamber 152. Alternatively, the port 202 may be connected to the hose as shown in FIG. 1, so that the check valve 186 also controls the level of pressure supplied to the gun 14. In this case, a transducer, pressure gauge, plug or other component may be connected to the threaded port 155 in the side of the pump discharge housing 36.

Figure 5:
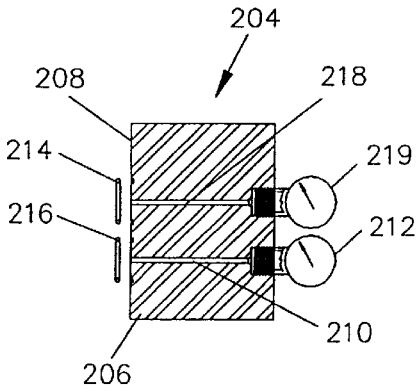
FIG. 5 is a cross-sectional view of a gauge adapting plate for mounting on opposing side of the discharge manifold.

The high pressure pump optionally also includes a gauge plate 204 thereon as generally shown in FIG. 1 and more specifically shown in FIG. 5. The gauge plate 204 includes a rectilinear block 206 with a face 208 for sealing engagement with an opposing face of the discharge housing 36. The passageway 210 in plate block 206 provides fluid communication between the pump discharge line 154 (or the upstream compression line portion 156) and a gauge or transducer 212 mounted to the gauge block to measure the pressure in a pump discharge flow line 154. Conventional O-ring seals 214 and 216 provide reliable sealed engagement between the block 206 and the discharge housing 36. The passageway 218 in the block 206 provides fluid communication to a similar gauge or transducer 219 which measures the fluid pressure in the chamber 152 in the front pressure housing portion 150. The passageway 218 may alternatively be a right angle passageway rather than a straight passageway as depicted. Various types of pressure gauges, switches, or strain gauges may be used to ensure that the pump is shut off and/or an alarm is activated if the pressure generated by the pump or if the pressure in the chamber 152 exceeds a predetermined limit. Various transducers may also be used to provide an appropriate signal to a computer in order to record the number of times the pump is turned on, and to record the level of pressure output by the pump.

Figure 6:
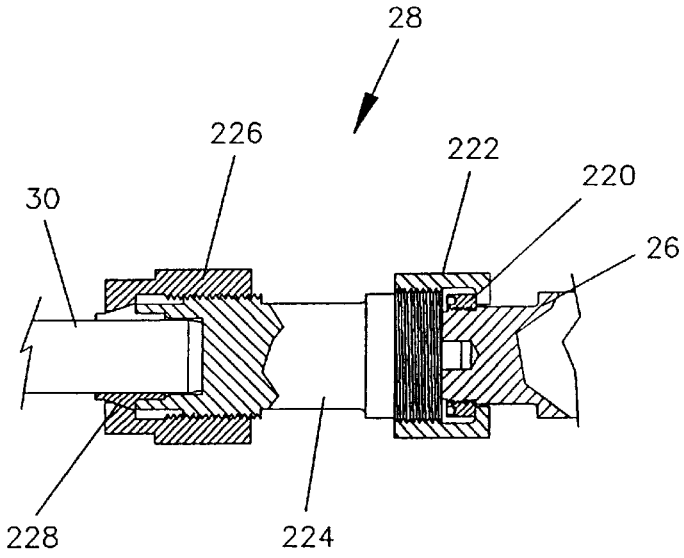
FIG. 6 is a side view, partially in cross-section, of an alignment connector for interconnecting a pump plunger and a pump rod.

FIG. 6 illustrates in further detail a suitable alignment connector 28 according to the present for structurally interconnecting the pump rod 26 from the power end of the pump to the plunger 30 which reciprocates within the fluid end of the pump. The alignment connector 28 includes an adapter ring 220 which may be threaded or otherwise structurally interconnected to one of the pump rod and plunger. For the embodiment as shown in FIG. 6, the adapter ring 220 is threadably connected to the pump rod. The alignment connector 28 also includes an adapter cap 222 which is removably connected with the plunger 30 and which is radially movable relative to the adapter ring 220. A short connector rod 224 interconnects the plunger 30 and the adapter cap 222. A nut 226 is threadably connected to the connector rod, and a connector bushing 228 interconnects the plunger 30 and the nut 226.

During use of the pump, some misalignment between the plunger 30 and the pump rod 26 is possible, since the adapter cap 222 may move radially with respect to the adapter ring 220, yet forces reliably transmitted between pump rod 26 and the plunger 30 for accomplishing the desired reciprocating motion. A significant feature of the alignment connector 28 as shown in FIG. 6 relates to service of the pump. The adapter cap 222 may be easily disconnected from the connector rod 224. Also, the nut 226 may be disconnected from the connector rod 224, so that the connector rod 224 may be easily disconnected from both the plunger 30 and the pump end 26. Removal of the short connector rod 224 thus facilitates removal of the gland nut 72 and thus replacement of the plunger packing.

After the service operation is complete, the alignment connector components may be reconnected to structurally interconnect the pump rod 26 with the plunger 30. The nut 226 may thus be tightened on the connector rod 224 to press against the connector bushing 228 and thus structurally interconnect the plunger 30 with the connector rod 224. The adapter cap 222 may similarly be tightened to structurally press the adapter cap against the adapter ring 220, while allowing for radial "play" between the adapter cap 222 and the ring 220. Those skilled in the art will appreciate that components as shown in FIG. 6 may be switched, and the adapter cap and adapter ring provided on the plunger end, and the nut and the connector bushing then provided on the pump rod.

For reasons explained above, the weep path is provided radially outward of the seal 66 between the plunger housing 24 and the seat 56. If desired, a similar weep path could be provided between the seat 56 and the pump discharge housing 36.

The overall design of the pump according to the present invention thus achieves a purpose as set forth above. Those skilled in the art will appreciate that many other modifications may be made to the embodiments described herein without departing from the spirit of the invention. The foregoing disclosure and description of the invention are thus illustrative, and changes in both the components of the pump and in the method of constructing and operating the pump can be made within the scope of the present invention, which is defined by the following claims.

What is claimed is:

1. A high pressure fluid pump, comprising:

a suction valve seat including a fluid inlet and a fluid outlet;

a plunger housing defining a cylindrical plunger chamber therein having a central axis:

a plunger linearly moveable within the plunger chamber along the central axis during stroking of the pump;

an inlet check valve for passing fluids from the fluid inlet to the plunger chamber and for preventing fluids from passing from the plunger chamber to the fluid inlet, the inlet check valve being axially moveable along the central axis for sealing engagement with the suction valve seat;

a discharge check valve for passing fluids from the plunger chamber and for preventing high pressure fluid downstream from the discharge check valve from returning to the plunger chamber, the discharge check valve being axially moveable along the central axis;

a discharge housing having a pump discharge flow line therein for receiving high pressure fluid passed by the discharge check valve from the pump chamber;

a plunger seal for sealing between the plunger housing and the plunger;

a stop sleeve positioned within the plunger chamber and in engagement with the suction valve seat;

a packing ring positioned within the plunger chamber for compressing the plunger seal; and a biasing member positioned within the plunger chamber for acting between the stop sleeve and the packing ring to exert an axially compressive force on the plunger seal through the packing ring.

2. The high pressure pump as defined in claim 1, wherein the packing ring has a uniform diameter outer surface for fitting engagement within the uniform diameter cylindrical bore within the plunger housing; and the packing ring has a uniform diameter inner surface for sliding engagement with an outer surface of the plunger, such that dead zones within the pump are minimized when the plunger is at the end of the pump compression stroke.

3. The high pressure pump as defined in claim 1, wherein the stop sleeve has a forward end adjacent the suction valve seat with a radial thickness less than 30% of a radial thickness of a rearward end of the stop sleeve adjacent the packing ring.

4. The high pressure pump as defined in claim 1, wherein the biasing member is a coil spring, and the packing ring extends axially from a front coil of the coil spring toward the stop sleeve to minimize dead zones within the pump.

5. A high pressure fluid pump, comprising:

a plunger housing defining a cylindrical plunger chamber therein having a central axis;

a plunger linearly moveable within the plunger chamber along the central axis during stroking of the pump;

an inlet check valve for passing fluids to the plunger chamber and for preventing fluids from passing from the plunger chamber to a pump inlet;

a discharge check valve for passing fluids from the plunger chamber and for preventing high pressure fluid downstream from the discharge check valve from returning to the plunger chamber;

a plunger seal for sealing between the plunger housing and the plunger;

a bushing positioned at least partially within the plunger chamber and fabricated from a selected bearing material, the bushing having a radially inner bore for guiding engagement with the linearly movable plunger and a front portion extending axially toward the plunger seal; and a sleeve ring positioned within the plunger chamber and fabricated from a selected high temperature resistant material, the sleeve ring being spaced radially between the front portion of the bushing and the plunger housing, thereby reducing the likelihood of the bushing becoming seized to the plunger housing.

6. The high pressure pump as defined in claim 5, when a bushing is fabricated from bronze and the high temperature resistant sleeve ring is fabricated from tungsten carbide.

7. The high pressure pump as defined in claim 5, wherein the front portion of the bushing includes a front compression face for engagement with the plunger seal.

8. The high pressure pump as defined in claim 5, further comprising:

a gland nut for removable engagement with the plunger housing, the gland nut pressing the bushing axially toward the plunger seal; and the sleeve ring extends axially from the plunger seal to adjacent a front end surface of the gland nut, such that substantially the entirety of a radially outer surface of the bushing is in engagement with one of the sleeve ring and the gland nut and is radially spaced from the plunger housing.

9. The high pressure pump as defined in claim 8, wherein the gland nut fixes the radial position of the bushing within the plunger housing and the sleeve ring fills an annular spacing between the front portion of the bushing and the plunger housing.

10. The high pressure fluid pump as defined in claim 5, further comprising:

a gland nut for removable engagement with the plunger housing, the gland nut pressing the bushing axially toward the plunger seal; and a cooling fluid inlet port in each of the plunger housing and gland nut and spaced axially opposite the discharge check valve with respect to the bushing for cooling the linearly movable plunger.

11. The high pressure pump as defined in claim 10, further comprising:

one or more cooling fluid discharge ports each spaced in the gland nut axially opposite the bushing with respect to the cooling fluid inlet port for discharging cooling fluid from the pump.

12. The high pressure pump as defined in claim 10, further comprising:

a pressure release groove spaced radially between an interior surface of the gland nut and an outer surface of a rear portion of the bushing and extending axially along the rear portion of the bushing, the pressure release groove being in fluid communication with the one or more cooling fluid discharge ports for releasing fluid which pass by the plunger seal.

13. A high pressure fluid pump, further comprising:

a suction valve seat including a fluid inlet and a fluid outlet;

a plunger housing defining a cylindrical plunger chamber therein having a central axis;

a plunger linearly moveable within the plunger chamber along the central axis during stroking of the pump;

an inlet check valve for passing fluids from the fluid inlet to the plunger chamber and for preventing fluids from passing from the plunger chamber to the fluid inlet, the inlet check valve being axially moveable along the central axis for sealing engagement with the suction valve seat;

a discharge check valve for passing fluids from the plunger chamber and for preventing high pressure fluid downstream from the discharge check valve from returning to the plunger chamber, the discharge check valve being axially moveable along the central axis;

a discharge housing having a pump discharge flow line therein for receiving high pressure fluid passed by the discharge check valve from the pump chamber;

a front plunger seal for sealing between the plunger housing and the plunger;

a rear suction valve seat seal for sealing between the plunger housing and the suction valve seat; and the plunger chamber within the plunger housing having a uniform diameter bore extending axially from the front plunger seal to the rear suction valve seat seal.

14. The high pressure pump as defined in claim 13, wherein the rear suction valve seat seal seals with a rear planar face of the plunger housing perpendicular to the central axis.

15. The high pressure pump as defined in claim 14, further comprising:

a plurality of compression rods circumferentially spaced about the central axis for pressing a rear planar face of the plunger housing into engagement with a front planar face of the suction valve seat, and for pressing a rear planar face of the suction valve seat into engagement with a front planar face of the discharge housing; and a weep path extending radially outward from the rear suction valve seat seal to a location exterior of the plunger housing for releasing fluids which pass by the rear suction valve seat seal.

16. The high pressure pump as defined in claim 15, wherein the weep path is formed as a weep groove in one of the front planar face of the suction valve seat of the rear planar face of the plunger housing.

17. The high pressure pump as defined in claim 13, wherein the suction valve seat seal has a nominal sealing diameter of less than 120 percent of a diameter of the cylindrical plunger chamber.

18. The high pressure fluid pump as defined in claim 13, further comprising:

a stop sleeve positioned within the plunger chamber and in engagement with the suction valve seat;

a packing ring positioned within the plunger chamber for compressing the plunger seal; and a biasing member positioned within the plunger chamber for acting between the stop sleeve and the packing ring to exert an axially compressive force on the plunger seal through the packing ring.

19. The high pressure pump as defined in claim 18, wherein the packing ring has a uniform diameter outer surface for fitting engagement within the uniform diameter cylindrical bore within the plunger housing; and the packing ring has a uniform diameter inner surface for sliding engagement with an outer surface of the plunger, such that dead zones within the pump are minimized when the plunger is at the end of the pump compression stroke.

20. The high pressure pump as defined in claim 18, wherein the stop sleeve has a forward end adjacent the suction valve seat with a radial thickness less than 30% of a radial thickness of a rearward end of the stop sleeve adjacent the packing ring.

21. A high pressure fluid pump, further comprising:

a plunger housing defining a cylindrical plunger chamber therein having a central axis, the plunger housing having a rear planar face;

a plunger linearly moveable within the plunger chamber along the central axis during stroking of the pump;

a suction valve seat including a fluid inlet and a fluid outlet, the suction valve seat being in sealed engagement with the rear planar face of the plunger housing;

an inlet check valve for passing fluids from the fluid inlet to the plunger chamber and for preventing fluids from passing from the plunger chamber to the fluid inlet;

a discharge check valve for passing fluids from the plunger chamber and for preventing high pressure fluid downstream from the discharge check valve from returning to the plunger chamber;

a plunger seal for sealing between the plunger housing and the plunger; and the plunger chamber within the plunger housing having a uniform diameter bore extending axially from the plunger seal to the rear planar face of the plunger housing in sealed engagement with suction valve seat.

22. The high pressure fluid pump as defined in claim 21, further comprising:

a stop sleeve positioned within the plunger chamber and in engagement with the suction valve seat;

a packing ring positioned within the plunger chamber for compressing the plunger seal; and a biasing member positioned within the plunger chamber for acting between the stop sleeve and the packing ring to exert an axially compressive force on the plunger seal through the packing ring.

23. The high pressure pump as defined in claim 22, wherein the packing ring has a uniform diameter outer surface for fitting engagement within the uniform diameter cylindrical bore within the plunger housing; and the packing ring has a uniform diameter inner surface for sliding engagement with an outer surface of the plunger, such that dead zones within the pump are minimized when the plunger is at the end of the pump compression stroke.

24. The high pressure pump as defined in claim 22, wherein the stop sleeve has a forward end adjacent the suction valve seat with a radial thickness less than 30% of a radial thickness of a rearward end of the stop sleeve adjacent the packing ring.

25. The high pressure pump as defined in claim 22, wherein the biasing member is a coil spring, and the packing ring extends axially from a front coil of the coil spring toward the stop sleeve to minimize dead zones within the pump.

26. A high pressure fluid pump, comprising:

a plunger housing defining a cylindrical plunger chamber therein having a central axis;

a plunger linearly moveable within the plunger chamber along the central axis during stroking of the pump;

a plunger seal for sealing between the plunger housing and the plunger;

a bushing positioned at least partially within the plunger chamber and fabricated from a selected bearing material, the bushing having a radially inner bore for guiding engagement with the linearly movable plunger and a front portion extending axially toward the plunger seal;

a sleeve ring positioned within the plunger chamber and fabricated from a selected high temperature resistant material, the sleeve ring being spaced radially between the front portion of the bushing and the plunger housing, thereby reducing the likelihood of the bushing becoming seized to the plunger housing; and a gland nut for removable engagement with the plunger housing, the gland nut pressing the bushing axially toward the plunger seal.

27. The high pressure pump as defined in claim 26, further comprising:

the sleeve ring extends axially from the plunger seal to adjacent a front end surface of the gland nut, such that substantially the entirety of a radially outer surface of the bushing is in engagement with one of the sleeve ring and the gland nut and is radially spaced from the plunger housing.

28. The high pressure pump as defined in claim 27, wherein the gland nut fixes the radial position of the bushing within the plunger housing and the sleeve ring fills an annular spacing between the front portion of the bushing and the plunger housing.

29. The high pressure fluid pump as defined in claim 26, further comprising:

a cooling fluid inlet port in each of the plunger housing and gland nut and spaced axially opposite the discharge check valve with respect to the bushing for cooling the linearly movable plunger.

30. The high pressure pump as defined in claim 29, further comprising:

one or more cooling fluid discharge ports each spaced in the gland nut axially opposite the bushing with respect to the cooling fluid inlet port for discharging cooling fluid from the pump.

31. The high pressure pump as defined in claim 29, further comprising:

a pressure release groove spaced radially between an interior surface of the gland nut and an outer surface of a rear portion of the bushing and extending axially along the rear portion of the bushing, the pressure release groove being in fluid communication with the one or more cooling fluid discharge ports for releasing fluid which pass by the plunger seal.

* * * * *